US005912197A

United States Patent [19]

Madderom

[11] Patent Number: 5,912,197

[45] Date of Patent: Jun. 15, 1999

[54] THERMAL SEALABLE PLASTIC MESH WEB FOR AUTOMATIC FORM, FILL AND SEAL MACHINE

[75] Inventor: Robert W. Madderom, Rhinelander, Wis.

[73] Assignee: C & H Packaging Company, Inc., Merrill, Wis.

[21] Appl. No.: 08/916,191

[22] Filed: Aug. 21, 1997

[51] Int. Cl.[6] ..... B65B 9/08; B32B 3/04

[52] U.S. Cl. ..... 442/305; 442/185; 442/186; 442/150; 53/451; 156/269; 156/522

[58] Field of Search ..... 442/185, 186, 442/189, 304, 305, 149, 150; 53/451, 552; 156/269, 290, 522

[56] References Cited

U.S. PATENT DOCUMENTS

| | | | |
|---|---|---|---|
| 2,512,216 | 6/1950 | Salfisberg | 271/2.6 |
| 2,815,620 | 12/1957 | Prodigo | 53/14 |
| 2,992,149 | 11/1961 | Drelich | 442/189 X |
| 3,173,232 | 3/1965 | Mercer | 53/137 |
| 3,293,824 | 12/1966 | Dorr | 53/131 |
| 3,432,980 | 3/1969 | Seiferth et al. | 53/14 |
| 3,732,666 | 5/1973 | Nakamura | 53/182 |
| 3,939,628 | 2/1976 | Schjeldahl | 53/29 |
| 4,282,055 | 8/1981 | Bosse et al. | 156/464 |
| 4,291,082 | 9/1981 | Stall | 442/185 X |
| 4,322,929 | 4/1982 | Neumann | 53/451 |
| 4,532,754 | 8/1985 | Hokanson | 53/451 |
| 4,554,202 | 11/1985 | Kamei et al. | 442/304 X |
| 4,563,231 | 1/1986 | Porrmann et al. | 156/90 |
| 5,529,659 | 6/1996 | Ellsworth et al. | 156/522 |
| 5,729,961 | 3/1998 | Dauder-Guardiola | 53/451 X |

OTHER PUBLICATIONS

Fox fresh mesh —Admitted Prior Art.

High Speed Three Side Seal Pouch Machine, BH–60HVL, Totani Giken Kogyo Co., Ltd.

Minigrip/Zip Pak, Ilapak, Inc.

*Primary Examiner*—Daniel Zirker

*Attorney, Agent, or Firm*—Andrus, Sceales, Starke & Sawall

[57] ABSTRACT

Filler strips made of a solid layer of thermal sealable material, such as separate strips of polyethylene film or other suitable thermal sealable films, are sequentially spaced on one side of a thermal sealable plastic mesh web at equal distance from one another. The pre-prepared web is used on a conventional form, fill and seal machine to form mesh bags having top and bottom fin seals with enhanced strength. The bag is primarily mesh so the product within the bag breathes easily. A thermal sealable print band may be located on the second side of the mesh. Different types of bags can be formed on different types of automatic form, fill and seal machines by modifying the specific configuration of the pre-prepared mesh web for the particular automatic form, fill and seal machine design.

12 Claims, 7 Drawing Sheets

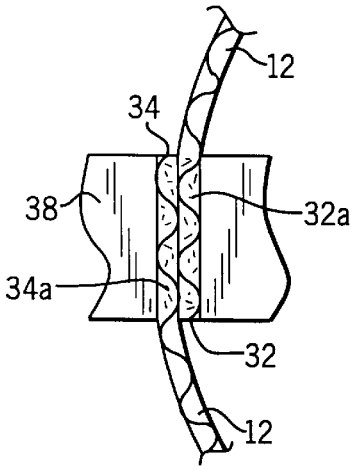
FIG. 6
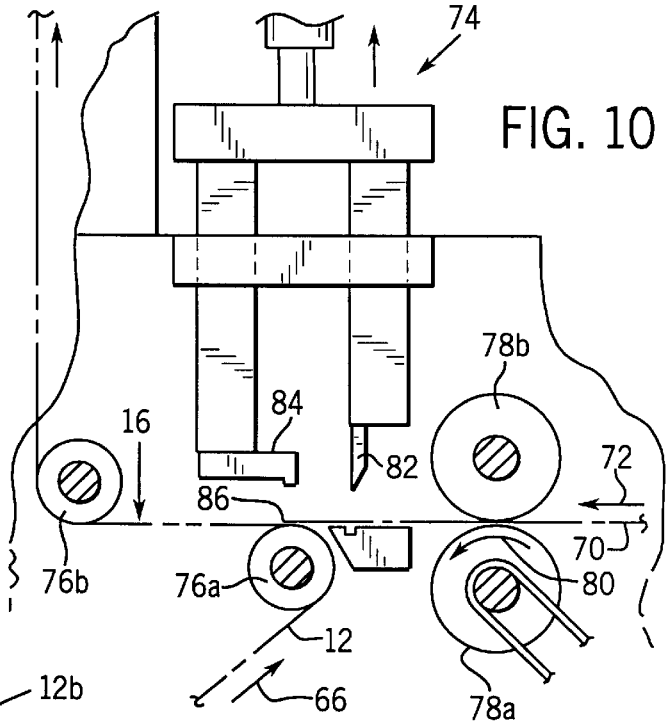
FIG. 10
FIG. 7
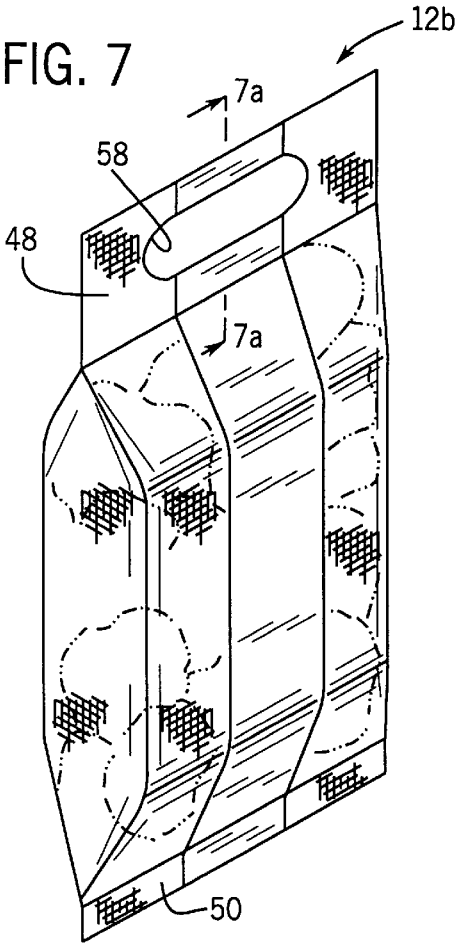
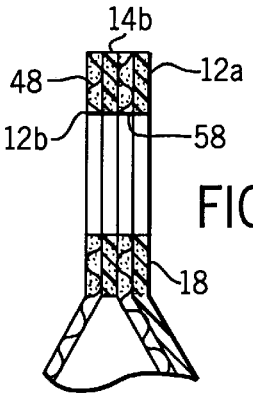
FIG. 7a
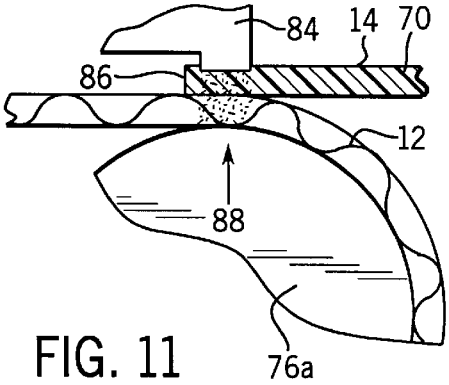
FIG. 11

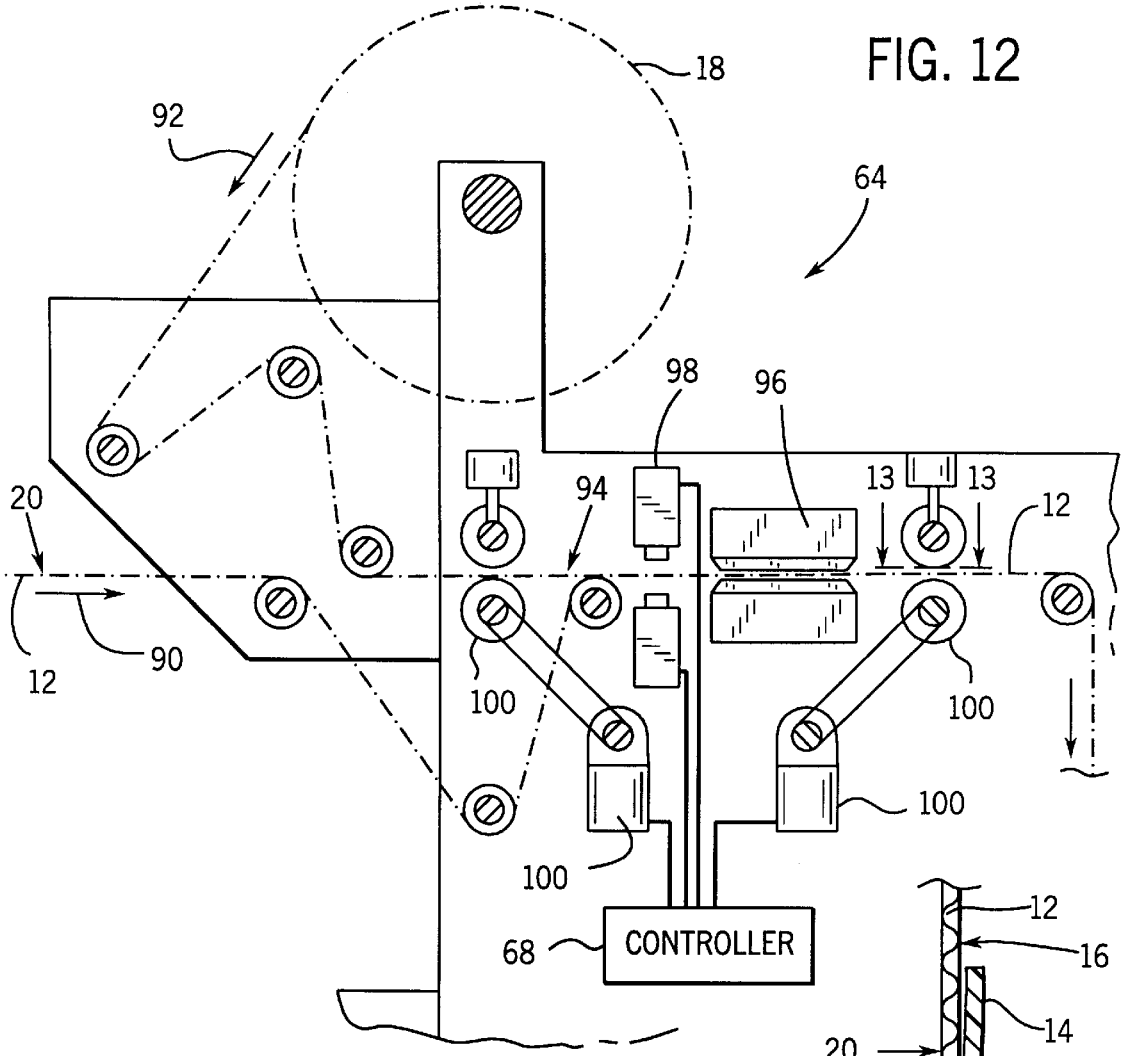
FIG. 12
FIG. 13
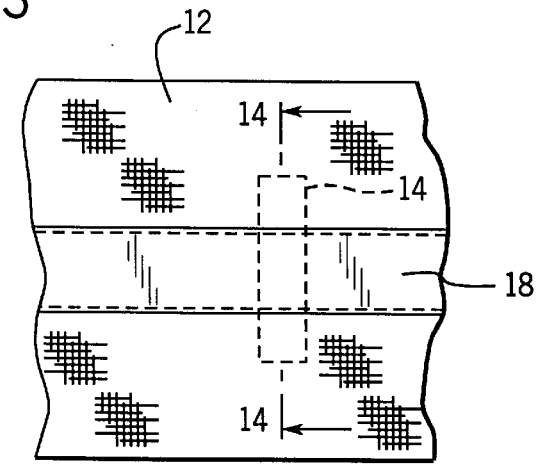
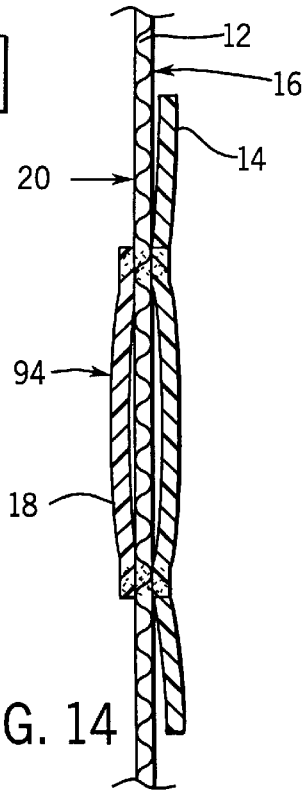
FIG. 14

FIG. 15
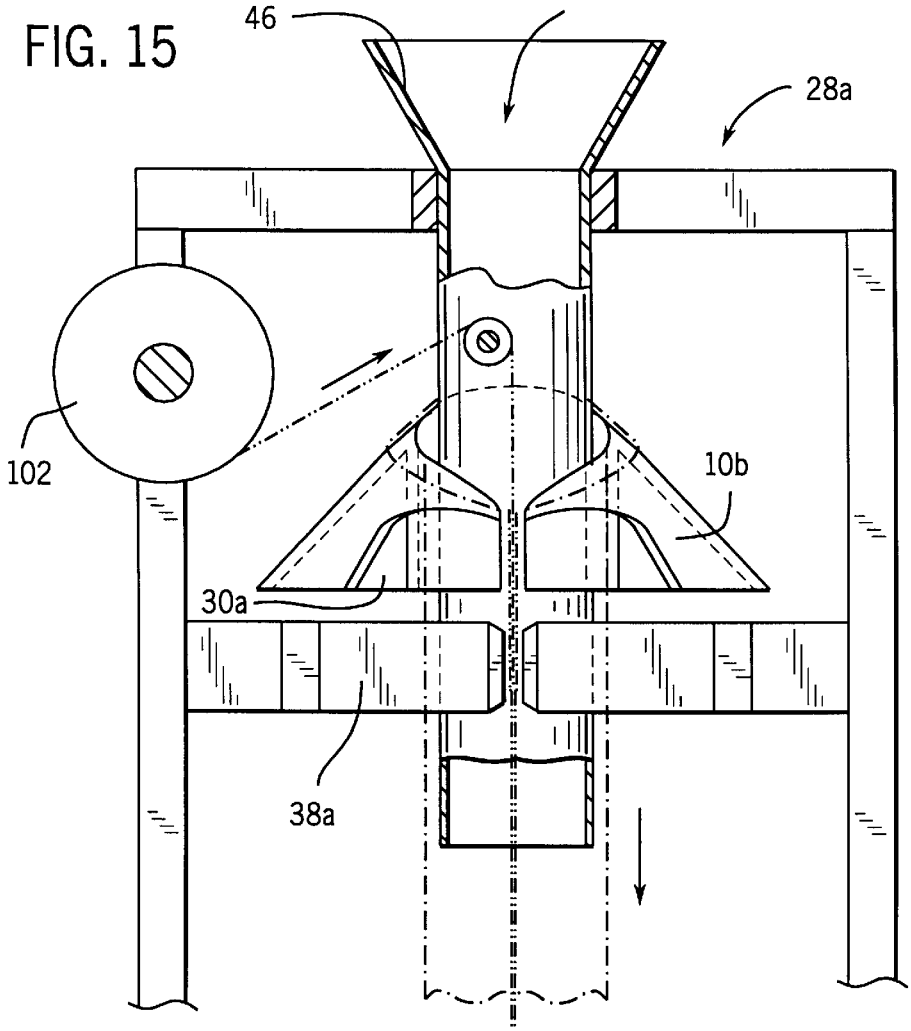
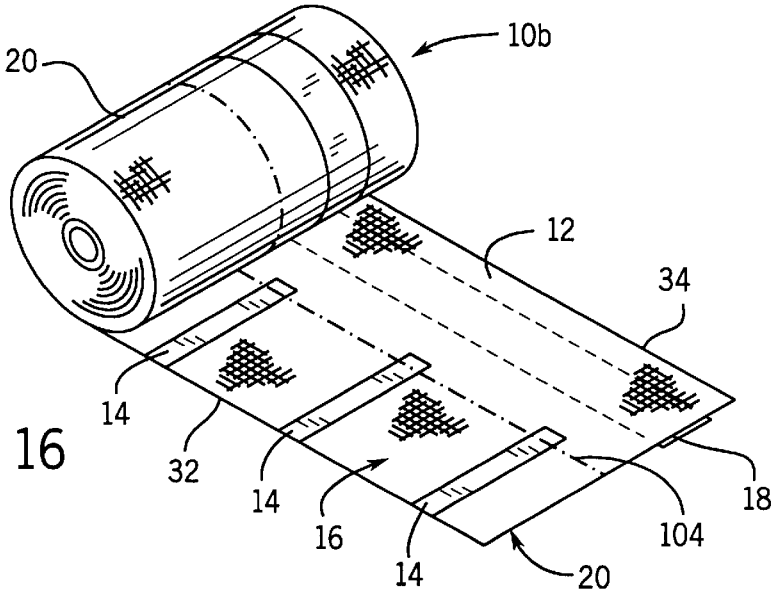
FIG. 16

THERMAL SEALABLE PLASTIC MESH WEB FOR AUTOMATIC FORM, FILL AND SEAL MACHINE

FIELD OF THE INVENTION

The invention relates to packaging materials used in automatic form, fill and seal machines. In particular, the invention relates to the use of thermal plastic mesh web as a packaging material for automatic form, fill and seal machines.

BACKGROUND OF THE INVENTION

Mesh bags are used to package various products, for instance, produce is often packaged in mesh bags to allow the produce to breath. Thermal sealable plastic mesh is often used to allow efficient application of thermal sealable print bands to the mesh for labelling and advertising. The mesh bags are preformed and filled either manually or semi-automatically. Thermal sealable plastic mesh is often used to allow efficient application of thermal sealable print bands to the mesh for labelling and advertising. The bottom cross seam of the preformed bags is normally sewn across the entire transverse length of the bag to provide sufficient bag strength. In the semiautomatic process, the preformed bag is secured to a filling mandril, the produce is manually put into the bag, and the top of the bag is hog-tied or crimped shut with a ring. This type of loading is labor-intensive and costly.

Automatic form, fill and seal machines are widely used in the packaging industry and significantly reduce packaging costs, especially labor costs associated with loading. Conventional automatic form, fill and seal machines contemporaneously form, fill and seal a bag from a heat sealable film continuously unwound from a roll. The process involves forming a tube from a layer of the heat sealable film unwound from the roll and heat sealing the longitudinal edges of the film together to form a back seam for the bag. The back seam is typically either a lap seal or a fin seal. The sealed tube is then pulled or driven downward for a distance equalling the length of the bag being formed. Transverse heat sealing jaws close to contemporaneously form the bottom cross seal for the bag and the top cross seal for the previous bag. The cross seal is cut and the previous bag falls into a bin or onto a conveyor, etc. At the same time, the open bag is filled. Automatic form, fill and seal machines are either gravity fed (e.g. vertical form, fill and seal machines) or mechanically fed (e.g. horizontal form, fill and seal machines).

Automatic form, fill and seal machines are efficient and cost effective when using many types of non-mesh films. However, bags produced from form, fill and seal machines using thermal sealable mesh have insufficient seam strength along the bottom and top fin seal for most practical uses. Therefore, to date, virtually all mesh bags are pre-formed with a sewn bottom cross seam.

SUMMARY OF THE INVENTION

The invention involves the use of a pre-prepared web of thermal sealable plastic mesh that includes equally spaced pre-attached filler strips of thermal sealable material. The filler strips are preferably cut from a film of solid thermal sealable material, such as polyethylene film having a thickness between 1 to 6 or possibly more mils. Such pre-prepared web enables practical use of thermal sealable mesh on conventional or slightly modified form, fill and seal machines. The filler strips are preferably located transverse along the mesh web and spaced apart equally at a distance equal to the length of a mesh bag. The filler strips provide an adequate mass of thermal sealable material along the top and bottom fin seals of the mesh to provide sufficient seam strength in practical applications.

The filler material preferably lies between the layers of bonded mesh at the transverse fin seal when the bag is formed and sealed. In order to provide an adequate seal, it is normally necessary to apply only one layer of filler material, for example 1–6 or more mils of polyethylene film or other heat sealable film, between the bonded layers of thermal sealable plastic mesh. In order to ensure adequate strength at the edges of the transverse fin seals, it may be desirable for the filler strip to double back slightly at the edges.

In most applications, it is desirable to also pre-attach a longitudinal print band to the side of the mesh web opposite the filler strips. In applications using longitudinal print bands, it may not be necessary to provide the filler strip for the portion of the cross seal where the print band is present, however, even in these applications it will be preferred to provide the filler strip across the entire transverse length of the cross seal.

In one preferred embodiment of the invention, the pre-prepared mesh web includes a longitudinal print band that is heat sealed and centered on one side of the thermal sealable plastic mesh web as is known in the art. On the other side of the mesh web, transverse filler strips of thermal sealable material for the top and bottom cross seals are centered over the print band. When the mesh web is run on a conventional form, fill and seal machine, the outer portions of the mesh web are preferably formed into a lap configuration for a back seal. The back seal is formed using a conventional heat sealing bar and the fin seals for the top and bottom cross seals are formed using a conventional heat sealer and cutter.

In some applications, it may be desirable to provide a fin seal for the back seal instead of an lap seal. In these applications, the pre-prepared mesh web should also include a continuous longitudinal strip of thermal sealable filler material along one of the longitudinal edges of the mesh web. In this manner, a reliable fin seal for the back seam can be formed on a conventional form, fill and seal machine modified to form a fin seal at the back seam. Such a continuous longitudinal strip can also be used to strengthen a lap seal.

Some automatic form, fill and seal machines have the ability to apply thermal sealable tape along the longitudinal seam during the forming process. Conventional thermal sealable tape often includes a zipper, although thermal sealable tape without a zipper is available. Thermal sealable tapes are folded when purchased in rolls from suppliers. The tape is typically applied during the form, fill and seal process by folding the web along a longitudinal seam and thereafter thermally attaching each side of the tape to the respective free edge of the folded web. For a form, fill and seal machine that applies a zipper, the thermal sealable filler strips on the mesh web are specifically configured. When using a pre-prepared thermal sealable plastic mesh web in this application, it is important that the thermal sealable filler strip be located properly on the mesh web so that thermal sealable filler material spans along the entire top and bottom cross seams when the bag is formed. Normally, this means that filler strips extend laterally from the longitudinal centerline of the mesh web outward in one transverse direction to a longitudinal edge of the mesh web.

Other features and advantages of the invention may be apparent to those skilled in the art upon inspecting the following drawings and description thereof.

BRIEF DESCRIPTION OF THE DRAWINGS

FIG. 6 is a detailed view taken along line 6—6 in FIG. 3 showing the fabrication of a back lap seal in accordance with the invention.

FIGS. 7 and 7*a* show a bag similar to that shown in FIG. 2 which also includes a handle opening through a top fin seal.

FIG. 10 schematically illustrates a filler strip attachment mechanism of the pouch machine shown in FIG. 9.

FIG. 11 is a detailed view showing the filler strip attachment mechanism attaching a filler strip to the mesh web.

FIG. 12 is a schematic illustration of the end section of the pouch machine shown in FIG. 9 in which a print band is attached to the pre-prepared web.

FIG. 13 is a view taken along line 13—13 in FIG. 12 showing another view of the pre-prepared web shown in FIG. 1.

FIG. 14 is a sectional view taken along line 14—14 in FIG. 13 which shows the attachment of the print band and the filler strips to the pre-prepared web.

FIG. 15 is a schematic illustration of a top portion of an automatic form, fill and seal machine which is capable of attaching zipper tape to the mesh web contemporaneously as the form, fill and seal machine is operating.

FIG. 16 is a perspective view of a pre-prepared mesh web configured for a form, fill and seal machine of the type shown in FIG. 15.

DETAILED DESCRIPTION OF THE DRAWINGS

Figure 1:
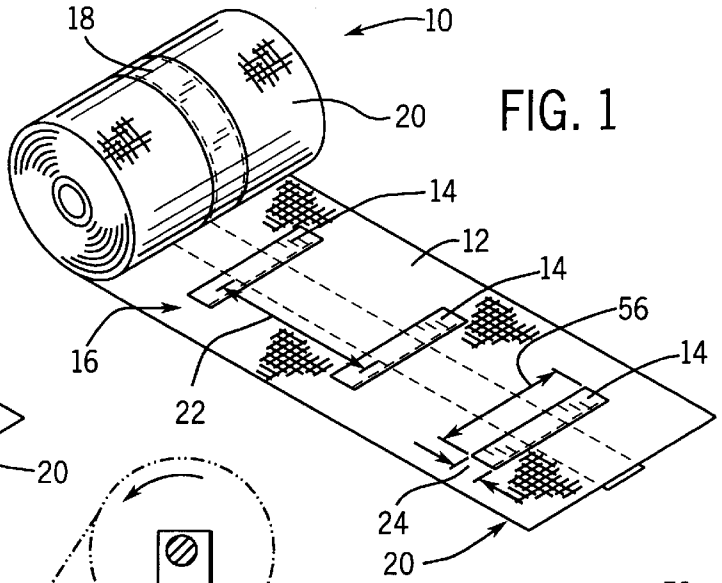
FIG. 1 is a perspective view of a mesh web that has been pre-prepared for an automatic form, fill and seal machine in accordance with the first embodiment of the invention.

FIG. 1 shows a roll of a pre-prepared web 10 for automatic form, film and seal packaging machines in accordance with a first embodiment of the invention. The pre-prepared web 10 includes a continuous longitudinal layer of thermal sealable plastic mesh 12, and in accordance with the invention a plurality of sequentially spaced filler strips 14. The sequentially spaced filler strips 14 are attached to a first side 16 of the continuous longitudinal layer of thermal sealable plastic mesh 12. Each filler strip 14 is preferably a solid layer of thermal sealable material, such as polyethylene film having a thickness between 1 to 6 or more mils.

Figure 2:
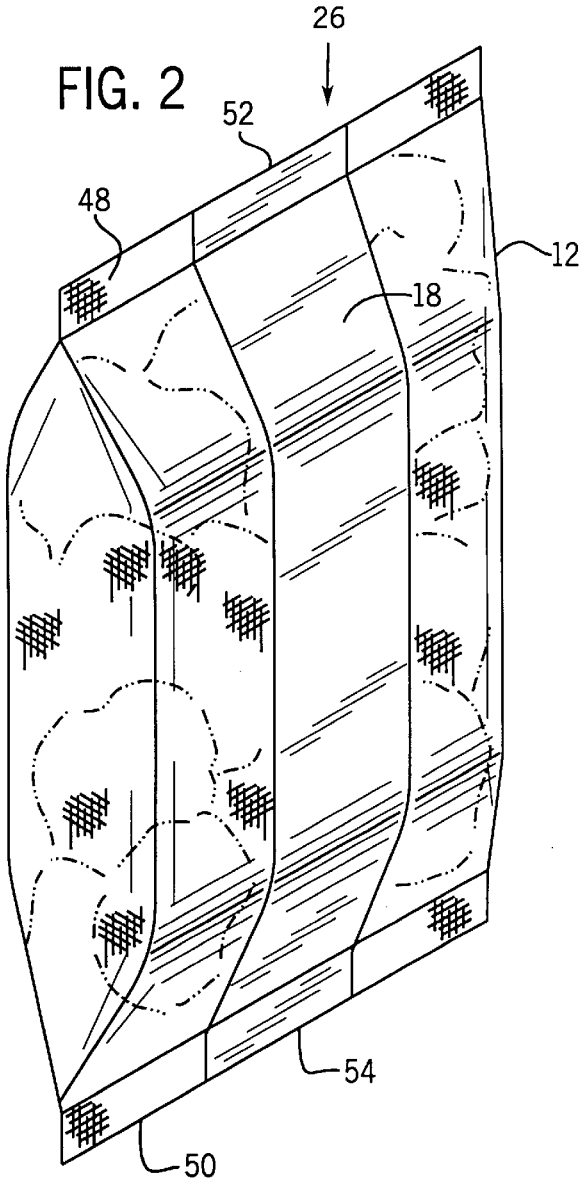
FIG. 2 is a mesh bag constructed on an automatic form, fill and seal machine using the pre-prepared web illustrated in FIG. 1.

The thermal sealable plastic mesh 12 is preferably a non-woven, polyethyrene mesh sold under the trade name CLAF. Thermal sealable CLAF mesh provides sufficient strength for heavy-duty packaging applications, while at the same time allows packaged products to breath. In addition, thermal sealable print bands can be efficiently attached to the mesh 12. FIG. 1 shows a print band 18 attached to a second side 20 of the layer of CLAF mesh 12. FIG. 2 shows a mesh bag 26 produced on a form, fill and seal packaging machine using the pre-prepared web 10 shown in FIG. 1.

The purpose of the filler strips 14 is to strengthen the top and bottom cross seals of bags formed on automatic form, fill and seal machines using the preprepared mesh web 10. Without the filler strips 14, the top and bottom cross seals would have insufficient strength for heavy-duty applications due to insufficient sealing mass for the mesh. The filler strips 14 are repeatably spaced apart longitudinally along the mesh web 12 at a longitudinal distance 22 defined by the distance between a bottom cross seal and a top cross seal of bags formed on automatic form, fill and seal machines using the pre-prepared web 10. Each filler strip 14 has a width 24 in the longitudinal direction of the continuous longitudinal layer 12 of thermal sealable plastic mesh which is at least as great as the combined width of the top cross seal and the bottom cross seal of bags formed on automatic form, fill and seal machines using the pre-prepared web 10.

Figure 4:
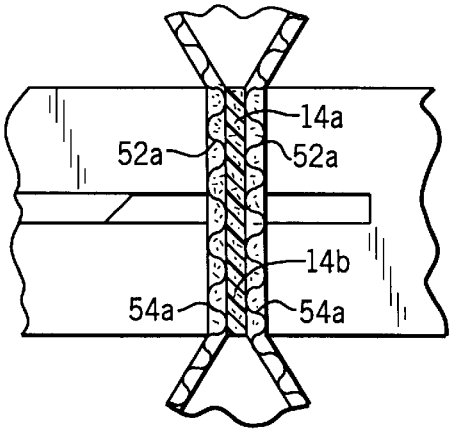
FIG. 4 is a detailed view of a heat sealing and cutting mechanism for the automatic form, fill and seal machine as shown in FIG. 3.
Figure 3:
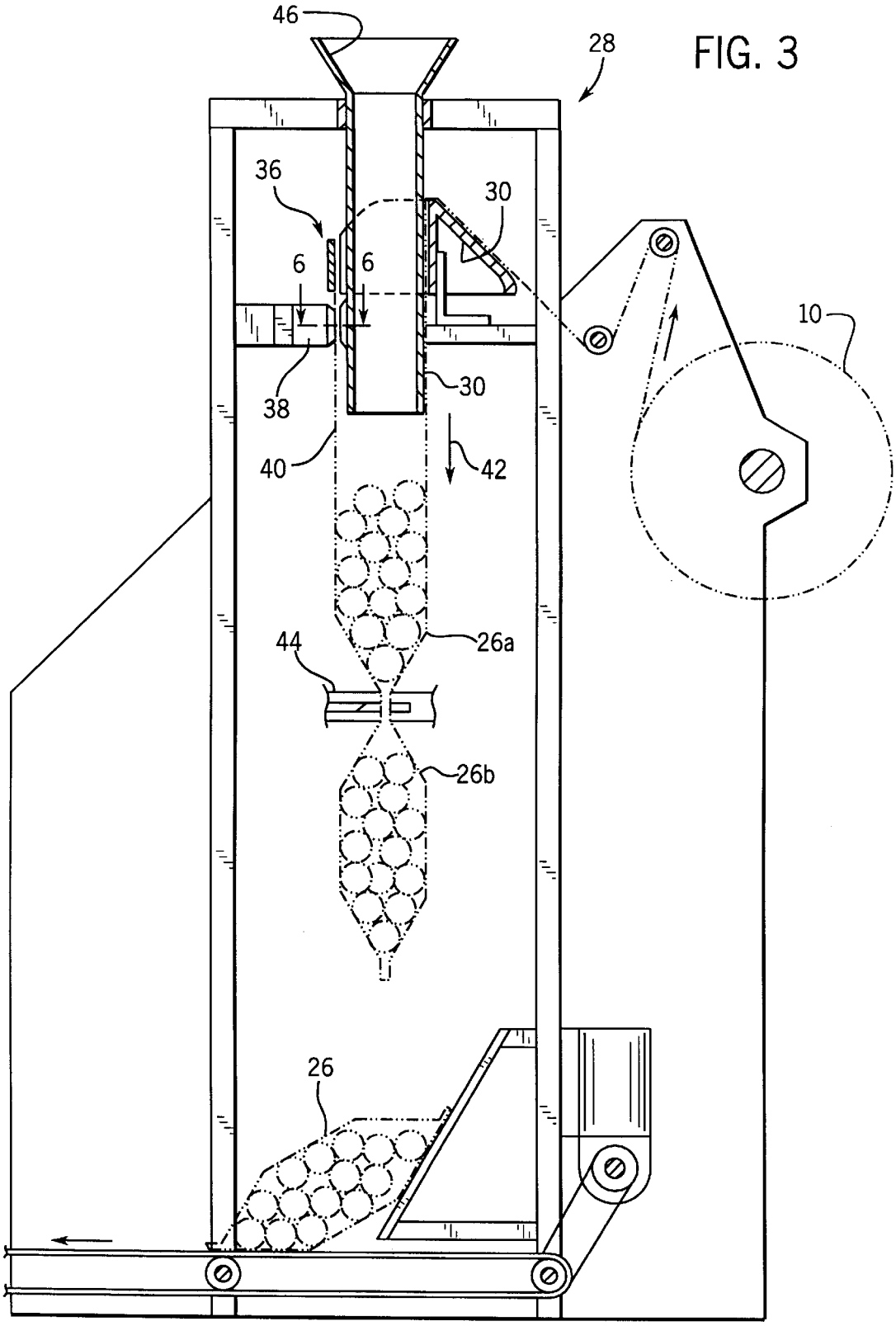
FIG. 3 is a schematic view of an automatic form, fill and seal machine using the mesh web shown in FIG. 1 to form the bag shown in FIG. 2.

A typical vertical form, fill and seal machine is shown in FIG. 3. Referring now to FIGS. 3–6, the roll of pre-prepared web material 10 is loaded on the vertical form, fill and seal machine 28, and is fed over a forming mandril 30 to form a tube as is known in the art. A first back sealing portion 32*a* adjacent a first longitudinal edge 32 of the web 10 and a second back sealing portion 34*a* adjacent a second longitudinal edge 34 of the web 10, FIG. 6, overlap one another in the forming mandril 30 generally in the vicinity of arrow 36, FIG. 3. Heat sealing bars 38 are located adjacent the forming mandril 30, and provide thermal energy to seal the first 32*a* and second back sealing portions 34*a* adjacent the first and second longitudinal edges of the layer of thermal sealable plastic mesh 12 to form a lap-type back seal for bags 26 formed by the machine 28. The heat-sealed tube 40 is then pulled downward of the forming mandril 30 (arrow 42) for a distance corresponding to the length of one bag 26. A cross sealing and cutting mechanism 44 clamps the tube 40 closed, and contemporaneously applies heat to form cross seals for the bags 26. The forming mandril 30 includes a spout 46 through which the packaged items (e.g. produce, balls, canned goods, etc.) are poured into the enclosed tube 40 of mesh when the cross sealing and cutting mechanism 44 is closed. When the cross sealing and cutting element 44 is closed, the cross sealing and cutting element severs the web 10 between the bag 26*a* being filled and the previous bag 26*b*, FIG. 3. The cross sealing and cutting mechanism 44 thus applies heat to contemporaneously form the bottom cross seal on the bag being filled 26*a* and the top cross seal on the previous bag 26*b*. When the cross sealing and cutting mechanism 44 opens, the previous bag 26*b* falls into a bin or onto a conveyor and the bag being filled 26*a* is drawn downward for the length of the bag 26*a* until the cross sealing and cutting mechanism 44 again closes to repeat the cycle. FIG. 4 shows the details of the cross sealing and cutting mechanism 44.

Figure 5:
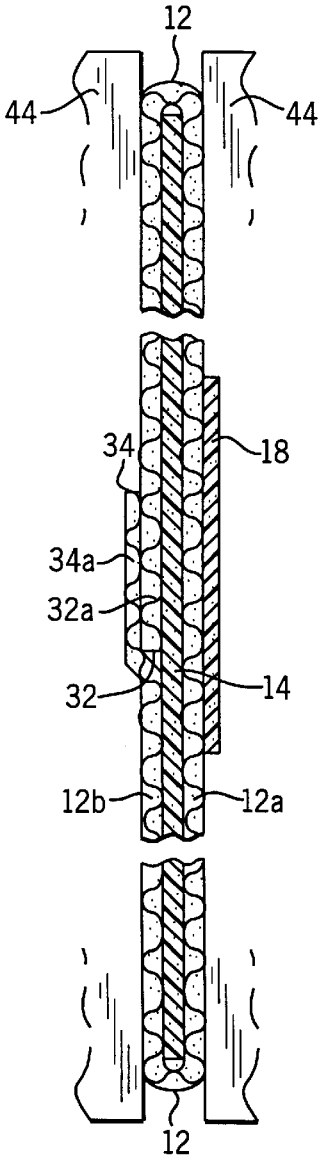
FIG. 5 is a sectional view taken along line 5—5 in FIG. 4 showing a fin seal fabricated in accordance with the invention.

FIG. 5 shows the various web layers clamped together in the cross sealing and cutting mechanism 44. The filler strip 14 is sandwiched between the layers 12*a*, 12*b* of the thermal sealable plastic mesh. As mentioned above, the filler strip 14 being made of a solid thermal sealable material provides sufficient mass to ensure an effective seal between the layers 12*a*, 12*b* of mesh. FIG. 5 also shows the print band 18 sealed to mesh layer 12*a* on the front of the bag 26, and the lap back seal at the back seam of the mesh 12*b*. It is preferred that the print band 18 be located on the side of the bag opposite the back lap seal 32*a*, 34*a* so that the print band 18 can be included as part of the pre-prepared web 10.

Referring again to FIGS. 1, 2, 4 and 5, the bags 26 formed on the machine 28 using the pre-prepared web 10 shown in FIG. 1 have a top fin seal 48 and a bottom fin seal 50 with sufficient strength to withstand heavy-duty applications. Each bag 26 has an enclosed rectangular layer of mesh 12 having the first 32*a* and second 34*a* back sealing portions as previously described, and also a bottom sealing portion 52*a* adjacent a bottom edge 52 of the bag 26 and a top sealing portion 54*a* adjacent a top edge 54 of the bag 26. The bottom sealing portion 52*a* is folded upon itself and sealed together with a bottom portion 14*a*, FIG. 4, of the filler strip 14 to form the bottom fin seal 50. Likewise, the top sealing portion 54 is folded upon itself and sealed together with a top portion 14*b* of the filler strip 14 sandwiched therebetween to form the top fin seal 48 for the bag 26. It is important that a solid layer of thermal sealable material be continuously present along both the top fin seal 48 and the bottom fin seal 50. This is most easily achieved by centering the filler strips on the first side 16 of the mesh 12, FIG. 1, and using filler strips 14 which have a transverse length 56 in the transverse direction across the mesh 12 which is greater than or equal to one-half of the distance between the first and second back sealing portions 32*a*, 34*a*. For the bag 26 of FIG. 2, this ensures that a sufficient amount of solid thermal sealable material is provided continuously along each top 48 and bottom 50 fin seal. In many applications, it is desirable that the transverse length 56 of the filler strips 14 across the mesh 12 be at least slightly greater than one-half of the distance between the first 32*a* and second 34*a* back sealing portions to provide additional sealing mass at the ends of the top 48 and bottom 50 fin seals.

FIG. 1 illustrates the preferred configuration of the pre-prepared web 10 in accordance with the first embodiment of the invention. Several alterations to the configuration of the pre-prepared web 10 can be made within the scope of the invention. For instance, in some applications it may not be necessary for each sequentially spaced filler strip 14 to span transversely over the region corresponding to the print band 18. It has been shown in at least some applications that the top 48 and bottom 50 fin seals can have sufficient strength as long as the combined continuous length of solid thermal sealable material spanning transversely across the mesh 12 formed by a combination of the print band 18 and the respective filler strip 14 is greater than or equal to one-half of the distance between the first 32*a* and second 34*a* back sealing portions. In this configuration, the filler strips 14 need not be placed over the mesh 12 portions corresponding to the print band 18, and the amount of filler strip material 14 can be reduced without affecting performance. On the other hand, it may be desirable in some applications to simply extend each filler strip 14 continuously between the first 32 and second 34 longitudinal edges of the pre-prepared web 10.

In the pre-prepared web shown in FIG. 1, the continuous print band 18 is centered on the second side 20 of the mesh 12 and the filler strips 14 are centered on the mesh 12, but are located on the first side 16 of the mesh 12. This is the preferred configuration to form the bag 26 shown in FIG. 2 because the configuration properly locates the print band 18 on the side of the bag 26 opposite the back seal 32*a*, 34*a* and also properly locates the filler strips 14 to provide a sufficient solid layer of thermal sealable material along both the top 48 and bottom 50 fin seals for the bag 26.

Figure 8:
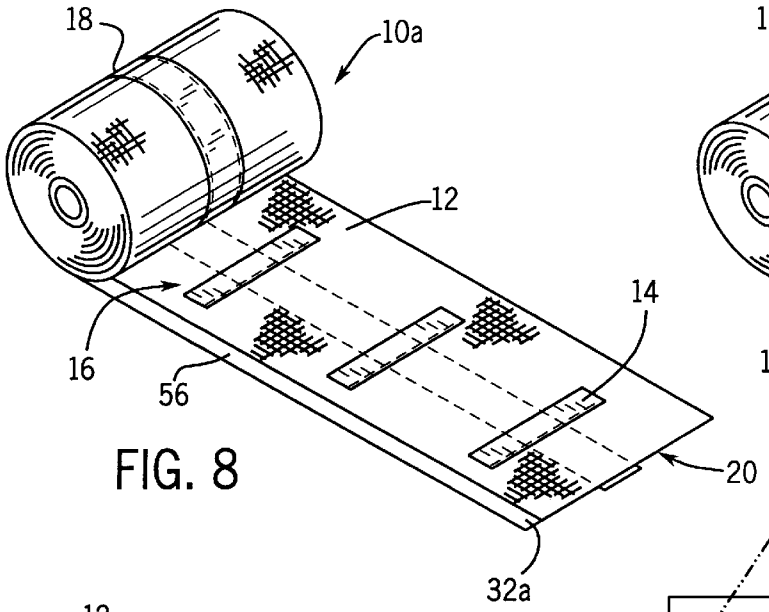
FIG. 8 is a perspective view of a second embodiment of a mesh web preprepared for use on an automatic form, fill and seal machine which has been modified to fabricate a fin seal along the back seam for the bag shown in FIG. 2.

In some applications, it may be desirable to replace the back lap seal 32*a*, 34*a* shown in FIG. 5, with a back fin seal. In these applications, the pre-prepared web 10 should be modified as shown in FIG. 8. FIG. 8 shows a pre-prepared web 10*a* similar to the web 10 shown in FIG. 1, however, the web 10*a* shown in FIG. 8 includes a continuous longitudinal filler strip 56 attached to the first side 16 of the mesh 12. Like transverse filler strips 14, the continuous longitudinal filler strip 56 is made of a solid thermal sealable plastic film. The continuous longitudinal filler strip 56 provides sufficient mass between the first 32*a* and second 34*a* back sealing portions when the bag 26 includes a fin seal at the back seam, rather than a back lap seal.

FIGS. 7 and 7*a* show a bag 126 in which the top 48 fin seal is enlarged, and includes a handle opening 58 die cut therethrough. For the bag 126 shown in FIGS. 7 and 7*a*, it is preferred that the width 24 of each filler strip 14 in the longitudinal direction of the layer of mesh 12 be increased to accommodate a larger top fin seal 48 and thus allow the handle opening 58 to have a significant size. The handle opening 58 may be die cut on-line using a modified cross sealing and cutting element 44, FIG. 3.

Figure 9:
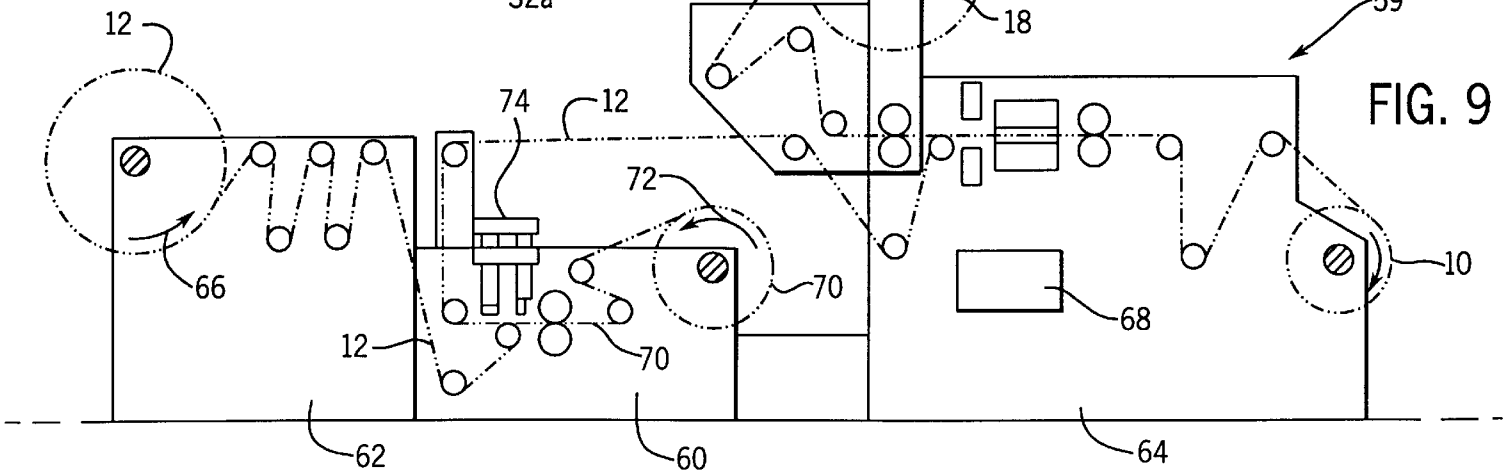
FIG. 9 is a schematic view of a pouch machine modified to fabricate the pre-prepared mesh web illustrated in FIG. 1.

FIGS. 9–14 illustrate a pouch machine 59 used to fabricate pre-prepared webs in accordance with the invention as shown in FIGS. 1, 8 and 15. The pouch machine 59 is a conventional pouch machine (e.g. high speed pouch machine from Totani Giken Kogyo Co., Ltd., Kyoto, Japan) that is modified by providing an additional section 60 to apply the filler strips 14 to the pre-prepared web 10. In general terms, the modified pouch machine 59 includes a beginning section 62, a middle section 60, and an end section 64. A blank roll of mesh 12 is loaded on the beginning section 62 and is unwound (arrow 66) in accordance with control signals from a system controller 68 which coordinates timing between the beginning 62, middle 60 and end 64 sections of the pouch machine 59. The blank mesh web 12 enters the middle portion 60 of the pouch machine 59. The transverse filler strips 14 and if desirable, a longitudinal filler strip 56, are attached to the mesh web 12 in the middle section 60 of the pouch machine 59. FIG. 9 specifically shows a roll 70 of a solid film of thermal sealable material, such as polyethylene film, being mounted to the middle section 60 of the pouch machine 59. The solid thermal sealable film 70 is unwound (arrow 72) in accordance with control signals from the controller 68. The mesh web 12 and the solid film of thermal sealable material 70 are both fed to a filler strip attachment mechanism 74 which automatically attaches the filler strips 14 to the first side 16 of the mesh web 12 in a sequentially spaced manner.

Details of the filler strip attachment mechanism 74 are shown in FIGS. 10 and 11. The mesh web 12 is fed through the filler strip attachment mechanism 74 around rollers 76*a*, 76*b* in such a manner that the first side 16 of the mesh web 12 is exposed to the filler strip film 70. The mesh web 12 is repeatedly fed through the filler strip attachment mechanism 74 in spaced intervals corresponding to the longitudinal distance between filler strips 14. As the mesh web 12 is fed through the filler strip attachment mechanism 74, the filler strip film is fed into the filler strip attachment mechanism 74 by filler strip feed rollers 78*a*, 78*b*. The filler strip feed rollers 78*a*, 78*b* are driven in accordance with timing control signals from the controller 68 in the direction of arrow 80. As the mesh web 12 indexes forward the distance equal to the length of a bag 26, the filler strip film 70 is contemporaneously fed so that a front edge 86 of the filler strip film 70 is located at the proper location 88 on the mesh web 12. The filler strip attachment mechanism 74 includes a knife 82 and a heat sealing bar 84 which are used to simultaneously 1) cut the filler strips 14 from the roll 70 of filler strip film, and 2) attach the separate filler strips to the first side 16 of the mesh web 12. Movement of the mesh web 12 is temporarily paused so that the heat sealing bar 84 can be moved downward to seal the front edge 86 of the filler strip 14 to the mesh 12 at location 88, see FIG. 11. As the front edge 86 of the filler strip film 70 is sealed to the mesh web 12, the filler strip film 70 is contemporaneously cut with knife 82 to create the separate filler strips 14. The system 58 then indexes forward to attach the next filler strip 14 in the same manner. The continuous longitudinal filler strip 56 of the roll 10*a* shown in FIG. 8 can be attached in a similar way, however, there is no need to cut a continuous longitudinal filler strip 56 with knife 82.

From the filler strip attachment mechanism 74, the mesh web 12 (with the filler strips 14 attached) is fed to the end section 64 of the modified pouch machine 59. A continuous print band 18 is also fed to the end section 64 of the pouch machine 59 as is known in the art. The print band 18 is a thermal sealable film normally having advertising or the like printed on a top side 94 of the film. Referring now to FIGS. 12–14, the mesh web 12 is fed into the end section of the pouch machine 59 (arrow 90) so that the second side 20 of the mesh web 12 is exposed to the continuous print band film fed from roll 18 into the end section 64 (arrow 92). The print band 18 is attached to the mesh web 12 in the conventional manner using heat sealing mechanism 96. Referring to FIGS. 13 and 14, the pre-prepared web 12 exits the heat sealing mechanism 96 in the end section 64 with the filler strips 14 attached to the first side 16 of the mesh web 12 and the print band 18 attached to the second side 20 of the mesh web 12. As shown best in FIG. 14, the heat sealing mechanism 96 not only attaches the print band 18 to the mesh web 12, but also helps to reinforce the attachment of the filler strips 14 to the mesh web 12.

FIG. 12 shows photosensors 98 on the end section 64 of the pouch machines 59 which are preferably used to detect indexing marks on the print bank 18. The photosensor 98 transmits signals to controller 68 which in turn controls the timing of the pouch machine 59 based on the location of the printed indexing marks on the print band 18. FIG. 12 specifically shows the controller 68 controlling the film drive system 100 for the end section 64, however, the controller also controls the operation of the front section 62 and the middle section 60.

Figure 17:
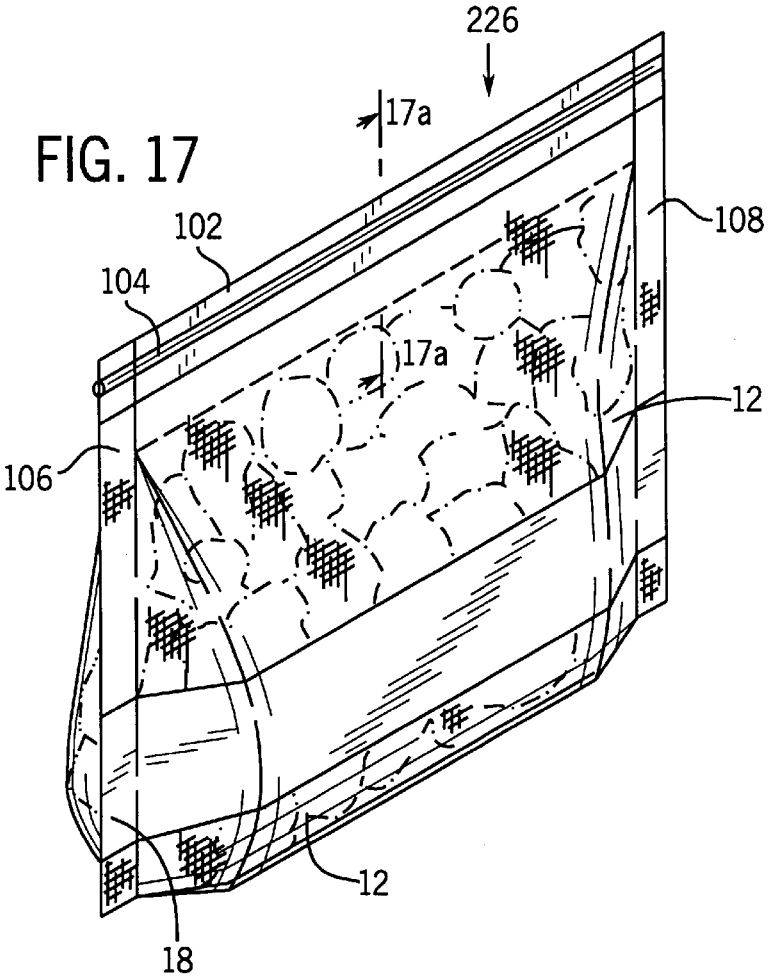
FIGS. 17 and 17*a* show a mesh bag with a zipper top formed using the pre-prepared mesh web shown in FIG. 16 on the automatic form, fill and seal machine shown in FIG. 15.

FIG. 17 shows a portion of an automatic form, fill and seal machine 28*a* which applies thermal sealable tape 102 to seal together the longitudinal edges 32*a*, 34*b* of the mesh web 12. The tape 102 is preferably a solid thermal sealable tape such as polyethylene film having a thickness between 1 to 6 or more mils. The tape 102 is normally folded on roll 102, and normally contains a longitudinal zipper 104, FIGS. 17, 17*a*. Still referring to FIG. 15, the form, fill and seal machine 28*a* works generally in the same method as the machine 28 shown in FIG. 3, however, the mandril 30*a* and the heat sealing mechanism 38*a* are modified on the machine 28*a* in FIG. 15 to accommodate the attachment of tape 102. The pre-prepared web 10*b* used on the machine 28*a* shown in FIG. 15 is shown in FIG. 16.

The pre-prepared web 10*b* shown in FIG. 16 has the filler strips 14 extending at least from the longitudinal centerline 104 of the mesh web 12 to either the first longitudinal edge 32 or the second longitudinal edge 34 of the mesh 12. In FIG. 16, the filler strips extend from the first longitudinal edge 32 of the mesh 12 transversely inward and slightly beyond the centerline 104 for the mesh 12. The print band 18 is also preferably attached between the centerline 104 and one of the longitudinal edges 32, 34 of the mesh web 12, but on the second side 20 of the mesh 12 rather than the first side 16 of the mesh 12. FIG. 6 shows the filler strips 14 offset with respect to the print band 18, however, it may be desirable to place the filler strips 14 on the same side of the centerline 104 as the print band 18.

Figure 17A:
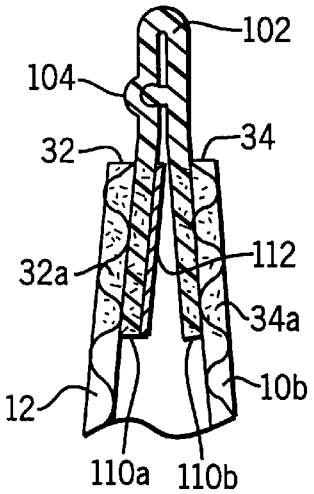

FIGS. 17 and 17*a* show a bag 226 formed by the form, fill and seal machine 28*a* shown in FIG. 15 which contemporaneously applies zipper tape 102. The bag 26*b* includes a first side seal 106 and a second side seal 108. The first 106 and second 108 side seals are fin seals which are formed by the sealing and cutting mechanism 44 shown in FIG. 3 in the same manner as top fin seal 48 and bottom fin seal 50 on bag 26 shown in FIG. 2. Thus, the filler strips 14 on the pre-prepared web 10*b* shown in FIG. 16 are used to provide additional sealing mass along the first 106 and second 108 side seals.

As illustrated by FIG. 15, the zipper tape 102 is attached to the mesh tube in the form, fill and seal machine 28*a* before the tube is clamped within the heat sealing and cutting mechanism 44 (FIG. 3) and filled with produce. FIG. 17*a* shows a cross-section for the preferred attachment of zipper tape to sealing portions 32*a*, 34*a* adjacent the first 32 and second 34 longitudinal edges of the web 10*b* shown in FIG. 16. The tape 102 includes sealing portions 110*a*, 110*b*. A shield 112 is attached to sealing portion 110*a* to prevent sealing portions 110*a*, 110*b* from sealing together when heat is applied. The zipper tape 102 extends continuously along the top edges 32, 34 of the mesh 12 continuously between the first 106 and second 108 side fin seals.

The invention has been described with respect to several preferred embodiments of the invention. It is recognized that various modifications, alternatives and equivalents may be apparent to those skilled in the art. The following claims should be interpreted to include such modifications, alternatives and equivalents.

I claim:

1. A pre-prepared web for automatic form, fill and seal packaging machines comprising:

a continuous longitudinal layer of thermal sealable plastic mesh having a first longitudinal edge and a second longitudinal edge parallel to the first longitudinal edge; and a plurality of sequentially spaced filler strips attached to a first side of the continuous longitudinal layer of thermal sealable plastic mesh, each filler strip being a solid layer of thermal sealable material, the filler strips being repeatably spaced apart longitudinally along the mesh web at a longitudinal distance defined by the distance between a bottom cross seal and a top cross seal of bags formed, filled and sealed on automatic form, fill and seat maces using the pre-prepared web, each filler strip having a width in the longitudinal direction of the continuous longitudinal layer of thermal sealable plastic mesh corresponding to at least the combined width of the top cross seal and the bottom cross seal of the bags formed, filled and sealed on automatic form, fill and seal machines using the pre-prepared web;

wherein the filler strips span transversely across the thermal sealable plastic mesh so that no open mesh is present along the top cross seal and along the bottom cross seal on the bags formed, filled and sealed on automatic form, fill and seal machines using the pre-prepared web.

2. A pre-prepared web for automatic form, fill and seal packaging machines as recited in claim 1 further comprising a continuous print band made of a solid thermal sealable film attached longitudinally to a second side of the continuous longitudinal layer of thermal sealable plastic mesh.

3. A pre-prepared web for automatic form, fill and seal packaging machines as recited in claim 2 wherein:

the continuous print band is centered on the second side of the continuous longitudinal layer of thermal sealable plastic mesh between the first and second longitudinal edges of the continuous longitudinal layer of thermal sealable plastic mesh; and the filler strips are centered on the first side of the continuous longitudinal layer of thermal sealable plastic mesh between the first and second longitudinal edges of the continuous longitudinal layer of thermal sealable plastic mesh, the transverse length of the filler strips as the filler strips span transversely across the continuous longitudinal layer of thermal sealable plastic mesh being greater than or equal to one-half of the distance between the first and second longitudinal edges of the continuous longitudinal layer of thermal sealable plastic mesh less than the distance that the first and second longitudinal edges overlap when forming bags on automatic form, fill and seal machines using the pre-prepared web.

4. A pre-prepared web for automatic form, fill and seal packaging machines as recited in claim 2 wherein:

the continuous print band is centered on the second side of the continuous longitudinal layer of thermal sealable plastic mesh between the first and second longitudinal edges of the continuous longitudinal layer of thermal sealable plastic mesh; and the combined transverse length of solid thermal sealable material spanning transversely across the continuous longitudinal layer of thermal sealable plastic mesh formed by a combination of the print band and the respective filler strips is greater than or equal to one-half of the distance between the first and second longitudinal edges of the continuous longitudinal layer of thermal sealable plastic mesh less than the distance that the first and second longitudinal edges overlap when forming bags on automatic form, fill and seal machines using the pre-prepared web.

5. A pre-prepared web for automatic form, fill and seal packaging machines as recited in claim 1 wherein the filler strips are centered on the first side of the continuous longitudinal layer of thermal sealable plastic mesh respectively between the first and second longitudinal edges of the continuous longitudinal layer of thermal sealable plastic mesh, and the transverse length of the filler strips is greater than or equal to one-half of the distance between the first and second longitudinal edges of the continuous longitudinal layer of thermal sealable plastic mesh less than the distance that the first and second longitudinal edges overlap when forming bags on automatic form, fill and seal machines using tie pre-prepared web.

6. A pre-prepared web for automatic form, fill and seal packaging machines as recited in claim 5 wherein the transverse length of the filler ships as the filler strips span across the continuous longitudinal layer of the thermal sealable plastic mesh is slightly greater than one-half of the distance between the first and second longitudinal edges of the continuous longitudinal layer of thermal sealable plastic mesh less than the distance that the first and second longitudinal edges overlap when forming bags on automatic form, fill and seal machines using the pre-prepared web.

7. A pre-prepared web for automatic form, fill and scat packaging machines as recited in claim 1 further comprising a continuous longitudinal filler strip attached to the first side of the continuous longitudinal layer of thermal sealable plastic mesh adjacent the first longitudinal edge of the continuous longitudinal layer of thermal sealable plastic mesh, the continuous longitudinal filler strip being made of a solid layer of thermal sealable material and having a width in the transverse direction across the continuous longitudinal layer of thermal sealable mesh corresponding to the width of a back fin seal for bags formed, filled and sealed on an automatic form, fill and seal machines using the pre-prepared web.

8. A pre-prepared web for automatic form, fill and seal packaging machines as recited in claim 2 wherein the print band includes a plurality of printed indexing marks repeatably spaced apart longitudinally along the continuous print band at a longitudinal distance defined by the distance between a bottom cross seal and a top cross seal for bags formed on automatic form, fill and seal machines using the pre-prepared web.

9. A pre-prepared web for automatic form, fill and seal packaging machines as recited in claim 2 wherein:

a centerline for the continuous longitudinal layer of thermal sealable plastic mesh is located symmetrically between the first and second longitudinal edges of the continuous longitudinal layer of thermal sealable plastic mesh;

the continuous print band is located on the second side of the continuous longitudinal layer of thermal sealable plastic mesh between the centerline and the second longitudinal edge of the continuous longitudinal layer of thermal sealable plastic mesh; and the filler strips are located on the first side of the continuous longitudinal layer of thermal sealable plastic mesh such that each filler strip spans transversely at least from the centerline to the first longitudinal edge of the continuous longitudinal layer of thermal sealable plastic mesh.

10. A pre-prepared web for automatic form, fill and seal packaging machines as recited in claim 1 wherein:

a centerline for the continuous longitudinal layer of thermal sealable plastic mesh is located symmetrically between the first and second longitudinal edges of the continuous longitudinal layer of thermal sealable plastic mesh; and filler strips are located on the first side of the continuous longitudinal layer of thermal sealable plastic mesh so that each filler strip spans transversely at least from the centerline to the first longitudinal edge of tie continuous longitudinal layer of thermal sealable plastic mesh.

11. A pre-prepared web for automatic form, fill and seal packaging machines as recited in claim 10 wherein each of the respective filler strips extends away from the first longitudinal edge of the continuous longitudinal layer of thermal sealable plastic mesh slightly over the centerline for the continuous longitudinal layer of thermal sealable plastic mesh.

12. A pre-prepared web for automatic form, fill and seal packaginig machines as recited in claim 1 wherein the filler strips are made of polyethylene film having a thickness between 1 and 6 mils.

* * * * *

UNITED STATES PATENT AND TRADEMARK OFFICE

CERTIFICATE OF CORRECTION

PATENT NO. : 5,912,197

DATED : June 15, 1999

INVENTOR(S) : ROBERT W. MADDEROM

It is certified that error appears in the above-indentified patent and that said Letters Patent is hereby corrected as shown below:

In claim 5, column 10, line 12, delete "tie" and substitute therefor ---the---. In claim 7, column 10, line 24, delete "scat" and substitute therefor ---seal---. In claim 10, column 11, line 7, delete "tie" and substitute therefor ---the---.

Column 11, line 4, insert --the-- before "filler".

Signed and Sealed this

Fourteenth Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,912,197
DATED : June 15, 1999
INVENTOR(S) : Robert W. Madderom

It is certified that error appears in the above-indentified patent and that said Letters Patent is hereby corrected as shown below:

In the Claims

In claim 1, column 9, line 7, delete "seat maces" and substitute therefor ---seal machines---.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*